United States Patent [19]

Ross et al.

[11] Patent Number: 4,852,888

[45] Date of Patent: Aug. 1, 1989

[54] ELECTRICALLY SCORING DART BOARD

[76] Inventors: Donald K. Ross, 1195 E. 347th St., Eastlake, Ohio 44094; Donald L. Luttermoser, 8789 Gract Ct., Mentor, Ohio 44060

[21] Appl. No.: 187,215

[22] Filed: Apr. 28, 1988

[51] Int. Cl.[4] ..... F41J 5/04

[52] U.S. Cl. ..... 273/373

[58] Field of Search ..... 273/373, 374, 378

[56] References Cited

U.S. PATENT DOCUMENTS

| | | | |
|---|---|---|---|
| 3,101,198 | 8/1963 | Williams | 273/373 |
| 3,677,546 | 7/1972 | Oetiker | 273/374 |
| 4,014,546 | 3/1977 | Steinkamp | 273/374 |

*Primary Examiner*—Edward M. Coven

*Assistant Examiner*—Benjamin Layno

*Attorney, Agent, or Firm*—Donald A. Bergquist

[57] ABSTRACT

This invention relates to a target board for electrically sensing the penetration of darts and similar missiles that do not penetrate entirely through the target. More specifically, the invention relates to the construction of a target board that is adapted to be a sensing device to trigger an electrical scoring device not of this invention wherein an electrical trigger circuit is closed upon the impact of a pointed missile partially penetrating the target board. A unique feature of this invention is that it allows the use of regulation-grade metal-pointed throwing darts of the type preferred by serious dart players, with no modifications made to the dart to accommodate the triggering of the target board circuit.

8 Claims, 4 Drawing Sheets

ELECTRICALLY SCORING DART BOARD

This invention relates to a target board for electrically sensing the penetration of darts and similar missiles that do not penetrate entirely through the target. More specifically, the invention relates to the construction of a target board that is adapted to be a sensing device to trigger an electrical scoring device not of this invention wherein an electrical trigger circuit is closed upon the impact of a pointed missile partially penetrating the target board. A unique feature of this invention is that it allows the use of regulation-grade metal-pointed throwing darts of the type preferred by serious dart players, with no modifications made to the dart to accommodate the triggering of the target board circuit.

Automatically scoring target boards have long been available for electrically conductive missiles that completely penetrate a target, especially for use with firearms. The general method used in such target boards is to have two electrically conductive sheets separated by a non-conductive sheet of a thickness less than the effective length of the missile; thus, an electrical circuit path is only momentarily completed between the two conductive sheets as the missile passes through the target board, providing a momentary signal pulse for an electrical scoring circuit.

When the missile remains in the target board while additional missiles impact the target board, a more sophisticated missile sensing system must be used. A previous inventor summarized the requirements as follows: "The first requirement is that there must be a reliable indication, usually electrical, when a missile strikes a target. The second requirement is that after a missile has struck the target the signal should be extinguished so that it can register again when the next missile strikes. The third requirement which applies only to targets in which the missile remains in the target is that there shall not be another indication when a missile is removed from a target."—U.S. Pat. No. 3,101,198, Williams. The present invention satisfies a fourth requirement that would be placed upon a board to be used by a serious dart player: that the sensing target board be suitable for use with regulation metal-tipped darts that are not modified in any way.

The adapting of this invention to the use of one's own darts is an important feature thereof, as serious dart players are very particular about the weight, the balance or weight distribution, the straightness, and the feathering of the darts they use in competition. Some players spend a lot of time and relatively large sums of money on evaluating, purchasing, making, or having made, darts to meet their stringent personal requirements. The serious dart player finds unsatisfactory the blunt-tipped, plastic tipped, and the shouldered tipped darts required for use with other automatic dart target boards.

It is for meeting the requirements of the serious dart player while providing for him the basis for an automatic electrical scoring target board and scoring system combination that this invention was created. This invention is one part of a total system that can provide a coin-operated dart game with automatic scoring wherein the user may use his own darts.

While the present discussion relates primarily to the game of darts, wherein sharp-tipped projectiles are hand-thrown to impact upon and stick in a target, it should be understood that other target games or sporting events would also benefit from the invention described herein. Such might include target practice involving archery, either with a longbow or with a crossbow, blowguns, and dartguns. The commonality shared by such activities is a projectile having an elongated, generally round sharp tip whose length is much greater than its diameter and whose tip is electrically conductive. It should be understood that this invention relates to target boards for all such activities.

DISCUSSION OF PRIOR ART

The previously-mentioned U.S. Pat. No. 3,101,198, issued in 1963 to J. F. Williams presents a target board wherein a resiliently-mounted first conductive mesh is spaced away from a second conductive layer, which may or may not be a mesh, and a projectile whose point includes a conductive portion at its tip, the length of the conductive portion being shorter than the spacing between the two conductive layers and whose point is sufficiently enlarged or shouldered so as to permit penetration of a limited length of the conductive portion of the point (which length is less than the inter-layer spacing) through the first conductive mesh. Upon impact of the projectile, the resilience of the first mesh initially allows simultaneous contact between the two conductive layers by way of the conductive portion of the projectile point, but subsequent relaxation of the resilient element moves the projectile's conductive portion from contact with the second conductive layer.

To paraphrase Williams' own patent, the invention of Williams is not useful with a dart point that is all metallic or with a dart that does not have a long enough metallic section at its tip to make contact when the first mesh is sprung momentarily inward. In contrast, the present invention is wholly intended to be useful with a dart whose point is of standard size and design and is all metallic, which is the norm for regulation-style high-quality darts s are used by the serious player.

SUMMARY OF THE INVENTION

It is an object of this invention to provide an impact-sensing target board for use with standard regulation-style projectiles that are in no way made special for the purposes of being compatible with the target board.

It is an object of this invention to provide a target board comprising, in spaced apart relationship, a conductive and penetrable first layer and a conductive, substantially impenetrable, resilient backing board.

It is an object of this invention to provide a target board comprising, in spaced apart relationship, a non-conductive first mesh, a conductive second mesh, and a conductive, substantially impenetrable, resilient backing board.

It is an object of this invention to provide a target board comprising, in spaced apart relationship, a non-conductive first mesh, a conductive second mesh having an elastomeric web closely spaced therebehind, and a conductive, substantially impenetrable, resilient backing board, wherein said elastomeric web elastically grips a dart point penetrating it to inhibit to some degree the removal of such a dart point.

It is an object of this invention that the target board described herein is adapted to be the sensing element in an electric scoring device.

BRIEF DESCRIPTION OF THE DRAWINGS

The invention will be described in greater detail in conjunction with the drawings, in which.

DETAILED DESCRIPTION OF THE INVENTION

Figure 1:
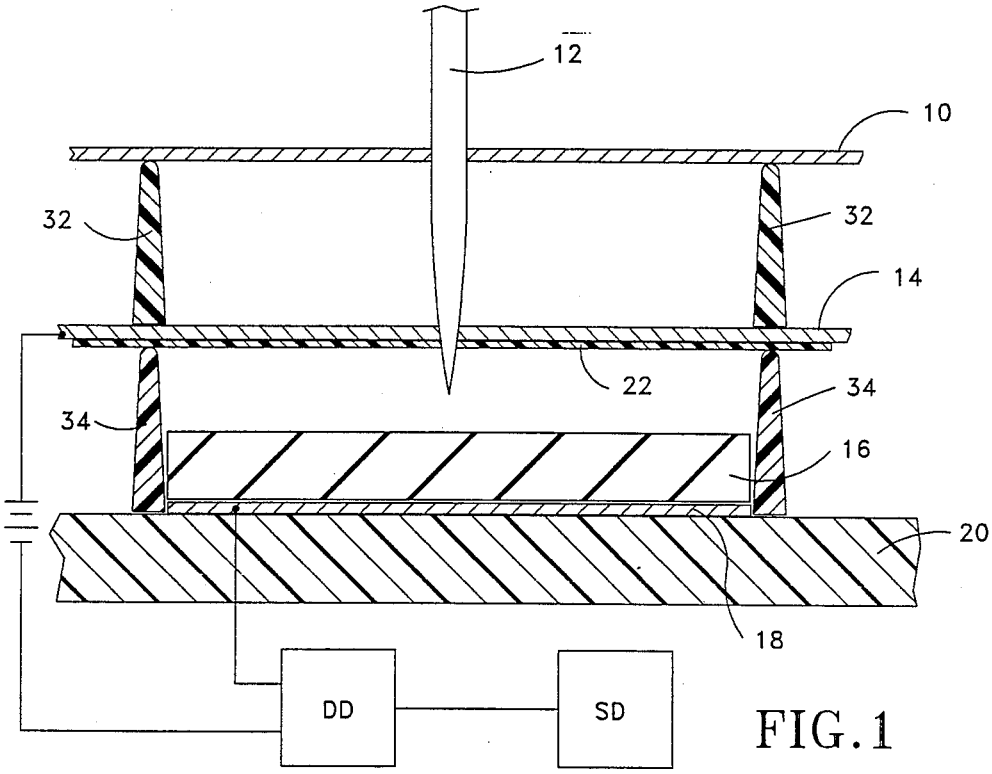
FIG. 1 is a cross-sectional view through the thickness of the targed board of the invention, a dart point having penetrated, rebounded, and come to rest.

In its simplest construction, the target board of this invention comprises two layers: a first conductive layer (preferably of conductive mesh) and, separated therefrom by an air space or a non-conductive easily penetrable material, a second conductive layer comprising a resilient conductive backing layer. A conductive projectile point penetrating the first conductive layer momentarily contacts the resilient second conductive layer and rebounds therefrom. The momentary contact, therefore, only momentarily completes an electrical circuit comprising the resilient conductive layer, the projectile's conductive point, and the first conductive layer. The momentarily completed circuit is sensed by electrical circuitry and scorekeeping circuitry that are outside the scope of this invention.

In practice, the invention is greatly enhanced by an additional layer that overlays the two basic layers and adds to the stability of the darts striking the board, keeping them in substantially the orientation in which they strike the target board, which is a feature that is highly desirable. This topmost layer also enhances the appearance of the target board. In the following detailed description, bear in mind that the layer described as the cover layer, along with any foam layers retained thereby, may be considered to be optional, present in improved modes, and especially present in the best mode.

The cover layer 10, which faces the player is a woven mesh, preferably of a relatively hard polymeric material. The pointed projectile 12 must pass relatively unobstructed through this mesh, so the woven strands are preferably of circular cross section and the weave is sufficiently loose to allow relatively easy sideways motion of the strand should the tip of the projectile impinge upon it. Such impingement may slightly deflect the strand or the projectile or both, but such deflection will be minimal. The surface of the strand should be sufficiently hard to not be penetrated by the sharp tip of the projectile. In practice, it has been found that a woven mesh of monofilament nylon, a 12.6 mesh by 0.023-inch diameter strand, for example, is very well suited for use as the cover layer.

The first conductive layer 14, which is spaced away from the cover layer 10 in substantially parallel relationship thereto, is preferably a conductive woven mesh layer. A conductive elastomeric foam might also be suitable, but such foams would require frequent replacement, whereas a conductive mesh does not. In the best mode, the first conductive layer 14 is a mesh woven of silver plated nylon strands. A slightly less favorable alternative is to silver plate a woven nylon mesh, but there may be a tendency during the plating process for the contact points of the crossing strands to become welded or cemented together, which should be avoided for reasons similar to those discussed for the cover layer 10. The size of the openings in the mesh of the first conductive layer 14 must be equal to or slightly smaller than the diameter of the generally cylindrically-shaped point of the projectile. The conductive mesh we have found that best meets our needs for use in this invention is a 16.6 mesh by 0.0137-inch diameter strand woven monofilament nylon mesh that has been plated with silver.

The second conductive layer 16, which is spaced away from the first conductive layer 14 in substantially parallel relationship thereto, is substantially impenetrable and is resilient. The resilient nature of this surface is principally responsible for the only momentary closing of the electrical circuit comprising the second conductive layer 16, the projectile point 12, which is conductive, and the first conductive layer 14. External electrical contact made to the backing board and the first conductive layer is made to an electrical detection device DD and an electrical scoring device SD, neither of which is within the scope of this invention, and of which several have been described in the patent literature and elsewhere.

It should be understood that the present invention is useful in all designs of targets. Thus, for example, in certain targets where it is desired to signal any hit on the target, the two conductive layers extend over the whole of the target and the signal produced when a projectile strikes does not tell what part of the target is struck. Other targets are partitioned, such as in the form of a bull's-eye with concentric rings, each ring representing a different score. To be adapted to this type of target, at least one of the conductive layers of the present invention must be segmented or partitioned to create a separate electrical circuit for each different scoring region. The target board of this invention is well suited to this type of application, as a resilient backing board may be provided having an electric circuit pattern printed directly thereon to provide many different scoring areas while the conductive mesh layer remains a continuous single contact. As a preferred alternative shown in the figures, however, a conductive resilient backing material 16 is used and each scoring area is backed by a separate piece of this conductive resilient backing material that, in turn, makes electrical contact with the desired array of electrical contacts 18 that may be in the form of individual wire-ends penetrating each section of the conductive backing material or a printed circuit board 20 on the back of the target board in the preferred mode.

Figure 3:
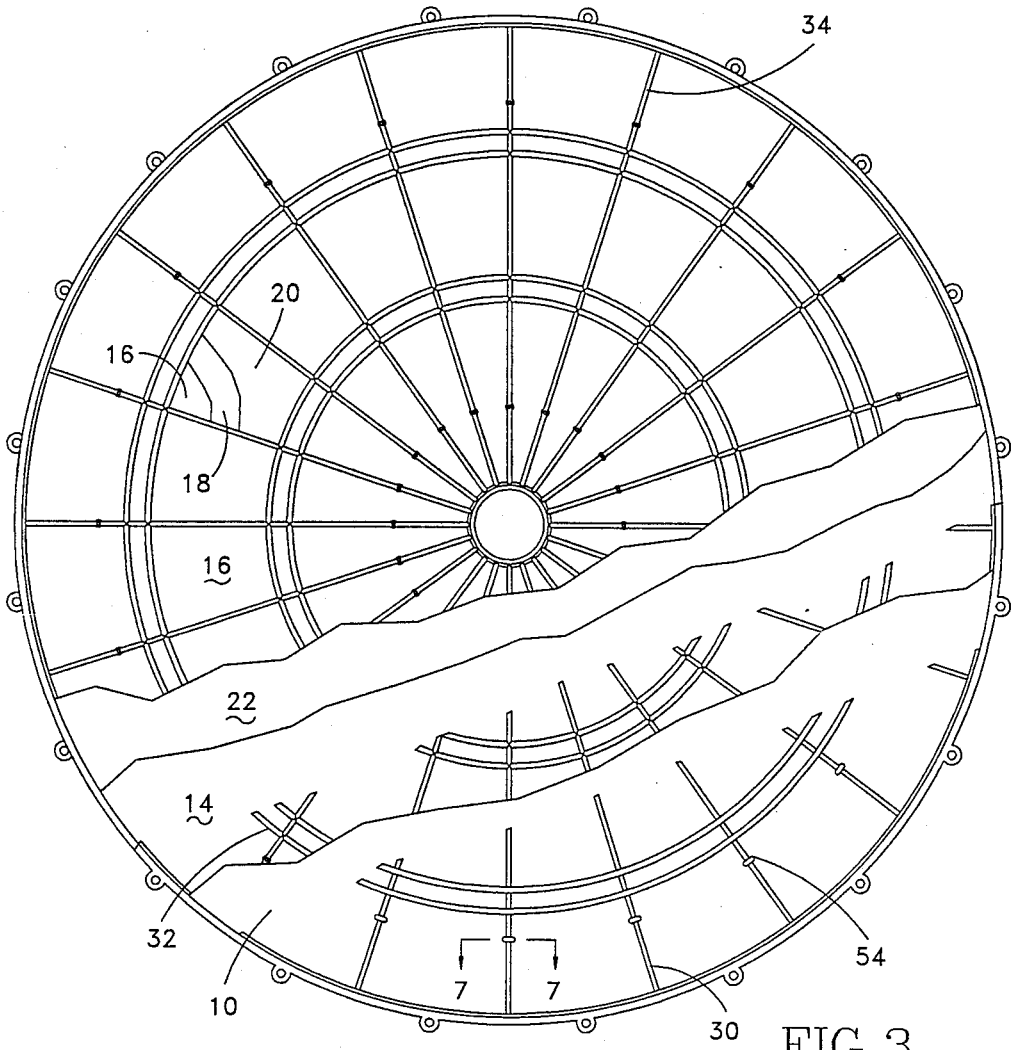
FIG. 3 is plan view of the dart board of the invention with progressive cutaways of the various layers thereof.

The construction of the target board of this invention is best accomplished by having three matching frame units, superimposed upon one another as shown in FIG. 3. The first frame unit 30 is preferably of metal wire construction composed of single or multiple parts and is similar to that used on other high quality dart target boards. Aside from defining for the player the various scoring zones, the primary function of this frame unit in the present invention is to provide a means for securing the mesh cover layer 10 that lies immediately beneath it.

The second frame unit 32 follows the grid pattern of the target, is aligned with the first frame unit and separates the cover mesh layer 10 from the first conductive layer 14. A third frame unit 34, which may be identical to the second, separates the first conductive layer 14 from the second conductive layer 16 and is best made of a non-conducting material. In practice, it has been found that injection molded plastic frames made from duPont DELRIN® acetal resin are well suited for use in this invention as the second and third frame units.

In practice it has been found that a circuit printed on a resilient backing board is suitable for use as the second conducting layer in this invention; the backing board providing the suitable rebound for the dart tip without being penetrated thereby, and the printed circuit providing the conductive layer thereon.

An alternative to this arrangement, and one that is to be preferred, is the use of a conductive hard rubber as a conductive rebound surface that comprises the second conductive layer 16. Where an array of scoring areas is required, multiple conductive hard rubber scoring segments, each separated from the others, may overlay a circuit pattern 18 printed on a backing board 20, which circuit pattern determines the scoring for each of the segments by connecting each to the electrical circuitry to which the target board is adapted for connecting. The simple mechanical contact between the printed circuit 18 and the back of the conductive hard rubber segment 16 provides sufficient electrical contact for transmitting the electrical pulse incident to the closure of the electrical circuit by the impact of the dart tip. In this preferred mode, there is no conductive coating on the resilient surface that might be worn away or damaged by the pointed tip of the dart. The conductive hard rubber we have found that best meets our needs for use in this invention is a 115 Durometer, Shore "A", nitrile rubber.

Figure 2:
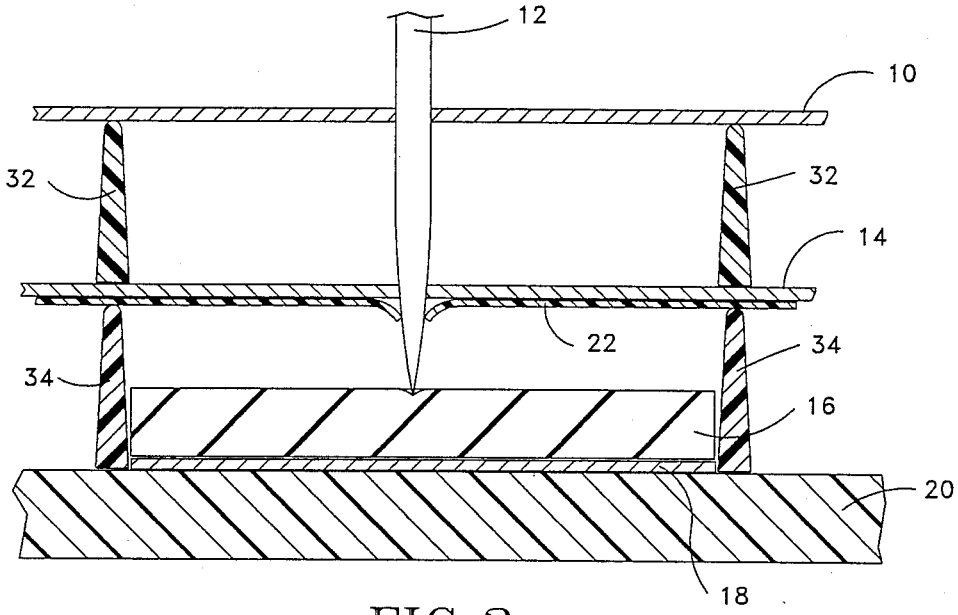
FIG. 2 is the same cross-sectional view through the thickness of the target board at a time just after a dart point has impacted upon the resilient backing surface, but before rebound of the dart point.

In practice it has been found that dart retention is improved by including on the back surface of one of the mesh layers an elastomeric sheet 22, preferably a cellular rubber or elastomeric foam, that, although it is easily penetrated by the pointed tip of the dart point, sufficiently grips the periphery of the dart point to retain the dart in the target board after the dart point has rebounded from the resilient surface. This elastomeric sheet is free to deform slightly away from the back surface of the mesh layer 14 as the dart point 12 penetrates the target board (shown in FIG. 2); upon rebound of the dart point, the elastomeric sheet gripping the shaft of the dart point rebounds with it until the sheet again contacts the mesh where it is stopped by the mesh (shown in FIG. 1); the elastomeric sheet then in turn stops the motion of the dart point. The static friction between the dart point and the elastomeric sheet is easily overcome as the dart is manually extracted from the target board. For various reasons it is preferred that the elastomeric sheet be located on the back of the second mesh layer, the conductive mesh of the first conductive layer 14. The elastomeric sheet is usually continuous over the entire area of the target board, being retained with the first conductive layer between two frame units. The elastomeric sheet we have found that best meets our needs for use in this invention is a #5100 closed cell sponge rubber.

Most games utilizing a target board have a target pattern or a scoring pattern that is usually printed on the surface of the target board. The front surface or cover layer 10 of the target board of this invention could be printed with such a pattern. In the preferred mode, however, the mesh comprising the cover layer 10 of the target board is translucent and the space between the cover layer and the first conductive layer is filled with a properly shaped piece of low density open-celled foam 40 of the appropriate color for each area of the target. These shapes usually match the openings in the second frame 32 used in the construction of the target board, but a single such opening could contain more than one colored foam element. In either case, this foam provides target regions of appropriate colors that will not fade or be worn away and which colors are readily visible by the user of the target board, though they are covered by the cover layer mesh 10. The openness or low density results in the foam's having little or no effect on the penetration of the dart tip. The open-celled foam we have found that best meets our needs for use in this invention is a 20 pores per inch filter foam.

Figure 6:
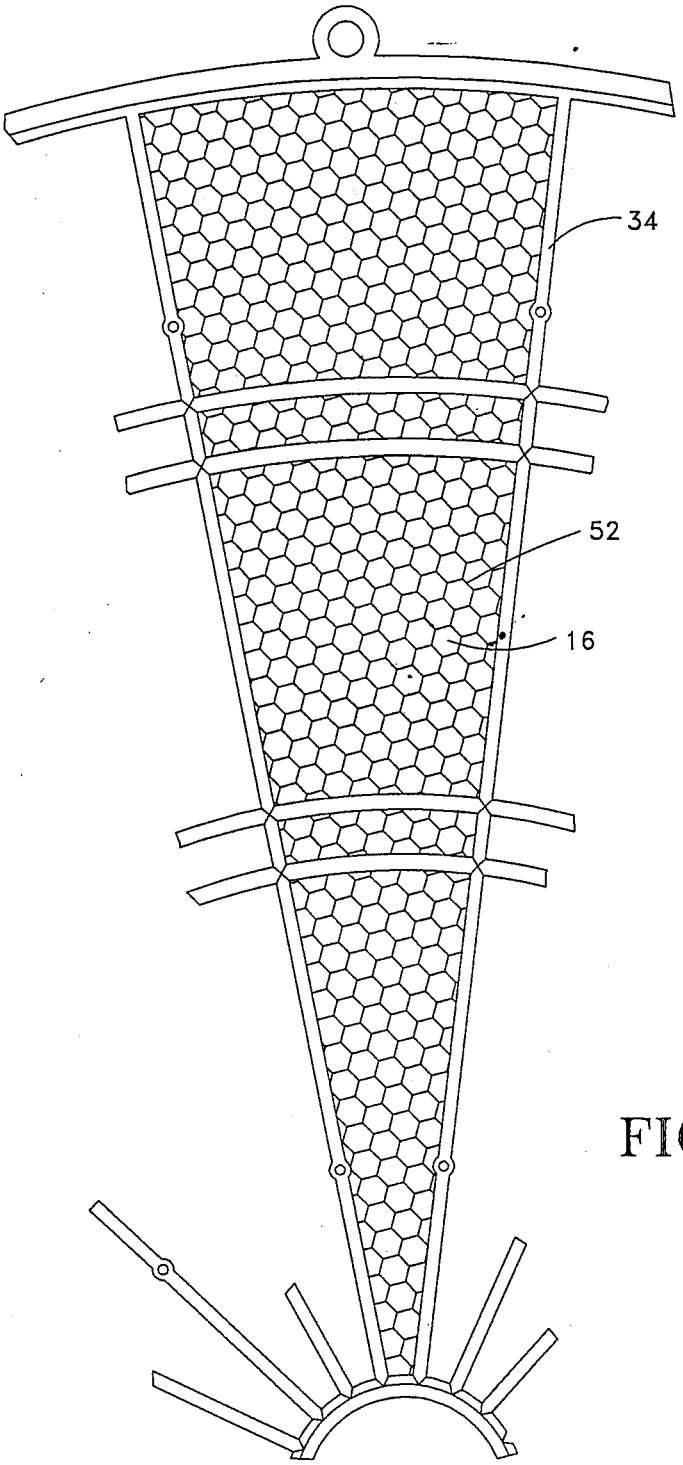
FIG. 6 is a partial plan view of a cutaway of one sector of a target board of the invention to show a hexagonal support means used in the best mode.

The addition of a support material in the open cavity between the first conductive layer and the second conductive layer may be used advantageously to further enhance dart retention, and is especially valuable in cases where the preferred elastomeric sheet is present. The deflection of this elastomeric sheet is limited by including between the elastomeric sheet and the conductive hard rubber surface 16 a support structure such as an open celled foam 50 or a honeycomb cellular material 52 with all cell walls perpendicular to the plane of the target board. The structure of the latter material is most clearly seen in FIG. 6. In one embodiment, the elastomeric sheet 22 is cut to fit the openings in the frame unit; in this embodiment a support material such as the honeycomb cellular material at this location is not optional but is required to keep the elastomeric sheet 22 in close proximity to the mesh layer 14 upon which its proper functioning depends. The honeycomb cellular support material we have found that best meets our needs for use in this invention has a $\frac{3}{8}$-inch cell size and is made from impregnated paper with no facing (i.e., each cell is open on both ends).

Although a metal wire frame on the target board is substantially required for the serious dart player, the target board of this invention could be used in other activities involving darts or other projectiles. In some of these cases it may be desirable to use an inexpensive replacible graphic overlay of paper or plastic on the front surface of the target board, which overlay would be easily penetrated by the sharp-tipped projectiles and would be disposed of when it is worn out by repeated use.

Figure 7:
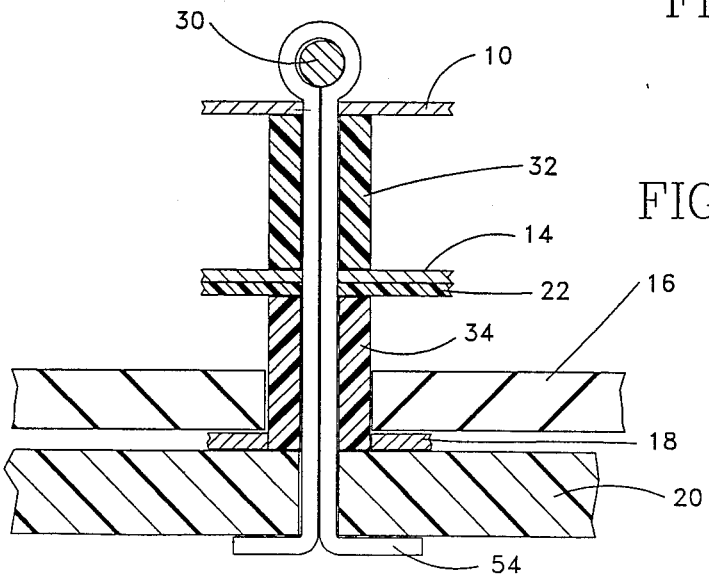
FIG. 7 is a cross sectional view as indicated by the line 7—7 in FIG. 3 to show the relationship among the various layers and attachments of the invention.
Figure 4:
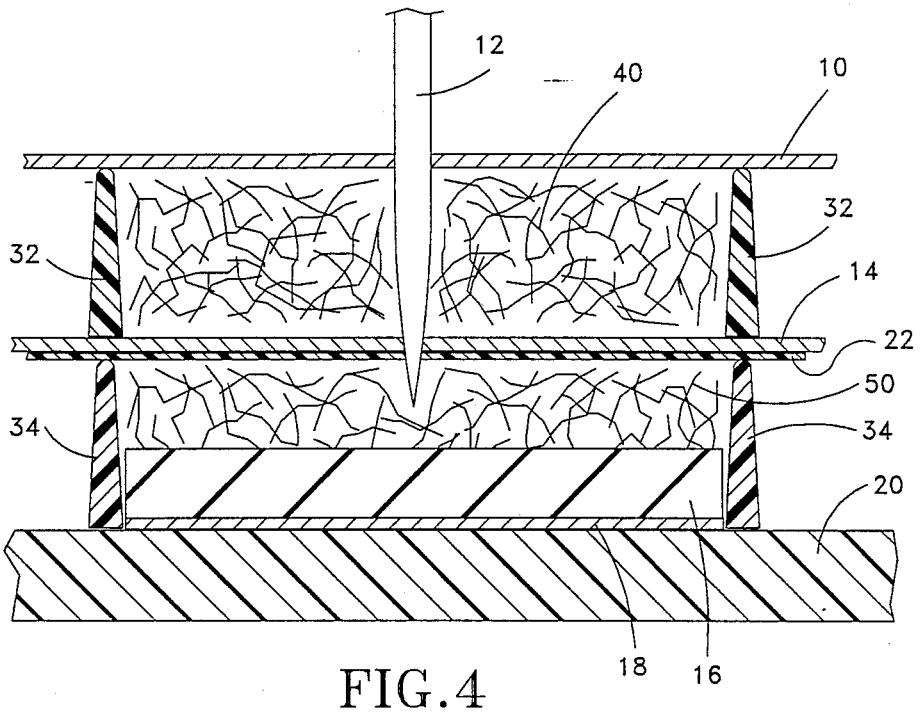
FIG. 4 is a cross-sectional view as in FIG. 1 in a different embodiment.
Figure 5:
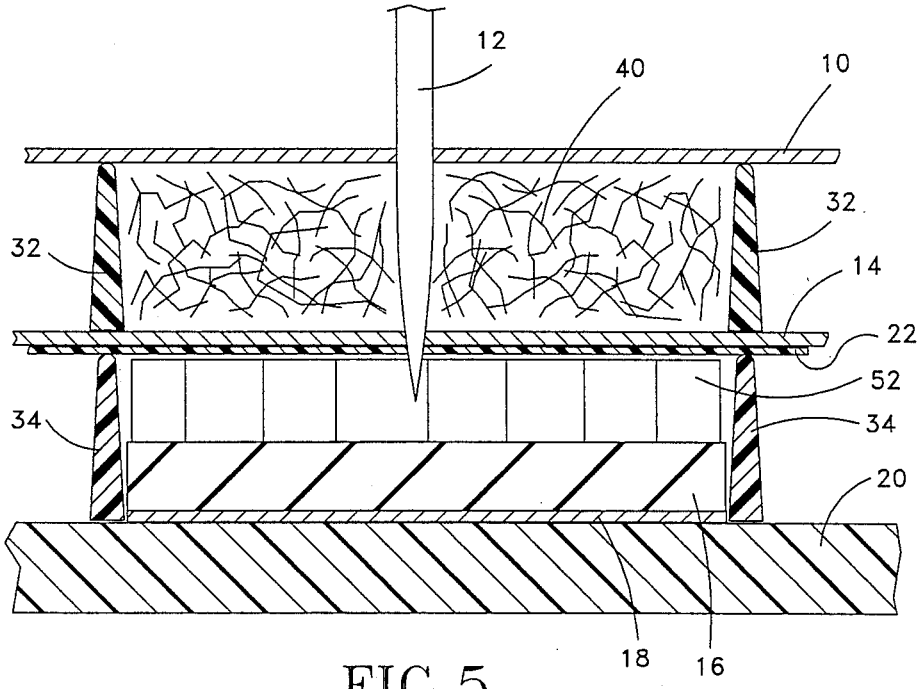
FIG. 5 is a cross-sectional view as in FIG. 1 in the preferred embodiment.

In the best mode of this invention, all of the various parts are replacable as the target board may be disassembled and separated, one layer from the other, for servicing either in the field or in a shop or factory location. This is made possible by the assembly of the target board from uniform and interchangeable die-cut sheet materials and carefully crafted wire-formed or injection molded frames wherein all of the sheet materials are either clamped between the frame members or totally enclosed by the frame and other sheet members. Assembly of the various layers to form the target board is by threaded fasteners and expansion pins 54 (i.e. cotter pins), detail of which is shown in FIG. 7.

Having described our invention in sufficient detail that one skilled in this art would be able to easily reproduce the article of the invention to obtain results similar to ours, and having described thereby the best mode of the invention, which has been achieved by experimental testing, we submit that our invention is not limited in scope by the examples specifically cited. Rather, the scope of the invention shall be limited only by the claims attached hereto.

We claim:

1. A target board adapted for use with projectiles having substantially cylindrically-shaped conductive points, said board comprising, in spaced apart relationship, a first conductive layer that is easily penetrable by said conductive point and a resilient second conductive layer that is substantially impenetrable by said conductive point, which target board may be adapted to an electrical circuit for detecting momentary circuit closures between said two conductive layers through said conductive-pointed projectile, and which target board may thereby sense the arrival of a conductive-pointed projectile by the momentary closing of the electrical circuit comprising, in series connection, said first conductive layer, said penetrating conductive projectile point, and said second conductive layer, which momentary closure is terminated when the point of said projectile rebounds and breaks contact with said resilient second conductive layer, which rebound is caused primarily by the resilient nature of said second conductive layer.

2. The target board of claim 1, wherein said resilient second conductive layer is conductive rubber.

3. The target board of claim 1, wherein there is present between said first and second conductive layers and in spaced apart relationship to said second conductive layer, a layer of elastomeric material that is easily penetrated by said projectile point and is capable of holding by friction the rebounding point of the projectile to keep the same from rebounding completely from said first conductive layer.

4. The target board of claim 3, wherein there is present between said elastomeric layer and said second conductive layer, an easily penetrable non-conductive material capable of maintaining the spaced-apart relationship between said elastomeric material and said second conductive layer.

5. The target board of claim 4, wherein said non-conductive material is capable of providing lateral support to the projectile after rebound.

6. The target board of claim 5, wherein said non-conductive material comprises a three-dimensional open-celled foam of polymeric material.

7. The target board of claim 5, wherein said non-conductive material comprises a three-dimensional structural product having hexagonal cells through the thickness thereof.

8. The target board of claim 1, 2, 3, 4, 5, 6, or 7, wherein there is present a top layer of non-conductive material, easily penetrated by said projectile point and in spaced apart, which top layer is in substantially parallel relationship to said first conductive layer and thereby capable of providing in cooperative action with said first conductive layer, lateral support for the projectile after rebound.

* * * * *